United States Patent [19]

Wagner

[11] 4,305,453

[45] Dec. 15, 1981

[54] SLIDE GUIDE FOR TUBE-TYPE HEAT EXCHANGER

[75] Inventor: William R. Wagner, Los Angeles, Calif.

[73] Assignee: Rockwell International Corporation, El Segundo, Calif.

[21] Appl. No.: 95,905

[22] Filed: Nov. 19, 1979

[51] Int. Cl.[3] ..... F28F 9/00

[52] U.S. Cl. ..... 165/69; 165/82; 165/162; 165/178

[58] Field of Search ..... 165/69, 134, 178, 82, 165/162

[56] References Cited

U.S. PATENT DOCUMENTS

| | | | |
|---|---|---|---|
| 3,012,761 | 12/1961 | Gardner et al. | 165/69 |
| 3,559,730 | 2/1971 | Denjean | 165/178 |
| 3,844,588 | 10/1974 | Jocsak | 165/69 |
| 4,156,299 | 5/1979 | Kovac | 165/178 |

FOREIGN PATENT DOCUMENTS

| | | | |
|---|---|---|---|
| 476182 | 4/1929 | Fed. Rep. of Germany | 165/178 |
| 2206792 | 8/1973 | Fed. Rep. of Germany | 165/162 |
| 1174506 | 12/1969 | United Kingdom | 165/178 |

*Primary Examiner*—Sheldon J. Richter
*Attorney, Agent, or Firm*—H. F. Hamann; Harry B. Field

[57] ABSTRACT

A slide guide 22 for a tube-type heat exchanger has a tubular geometry and comprises saddle 28 and slots 26 interposed one each between fingers 24. Saddle 28 positions slide guide 22 within tube support sheet port 30 while fingers 24 are biased so as to conform to the ovality of tube 12 and dissipate dynamic loads across a relatively large tube surface area.

3 Claims, 3 Drawing Figures

SLIDE GUIDE FOR TUBE-TYPE HEAT EXCHANGER

BACKGROUND OF THE INVENTION

1. Field of the Invention

This invention pertains to heat exchangers and, more specifically, to a slide guide for cushioning tubes in a tube-type heat exchanger.

2. Description of the Prior Art

Heat exchanger manifolds such as those described in U.S. Pat. No. 3,689,972 to Mosier et al., in copending U.S. Pat. application Ser. No. 78,125 filed Sept. 24, 1979 to Rosman et al, and in copending U.S. Pat. application Ser. No. 095,287 filed Nov. 19, 1979 entitled "Yieldable Connector for Tube-Type Heat Exchanger" to Wagner, included herein by reference, have provided means of joining outer concentric tubes to a manifold. Rosman et al and Wagner likewise teach methods of joining inner tubes of a tube-in-tube heat exchanger to a manifold. However, the expansion and contraction of the heat exchanger tubes relative to the manifolds and mechanical stability of individual tubes has been a source of tube failure and heat transfer inefficiency.

FIG. 1 illustrates the conventional prior art for a heat exchanger tube penetration through a longitudinal periodically-spaced tube support sheet or flow baffle 10. In general, the sheet 10 thickness (t) is maintained thin for drilling, punching or stamping purposes. Also for cost and weight purposes the (t) value is minimized. In general practice, although undesirable, either edge 14 or 16 of the punched hole is a minimum radius element. A diametral clearance $\delta$ is provided also of a generally large value to ensure that the slight ovality, tube-to-tube diameter differences, and axial non-straightness are accepted during a low-cost easy assembly.

The heat exchanger operation is such that the heat exchange process is accompanied by fluid oscillations and noise occurring naturally as a result of frictional and aerodynamic dissipation both inside of and outside of the tube element 12. This oscillation results in the buffeting of the tube 12 in the sheet 10 radially and to some extent longitudinally with the center N as a nodal point. Moreover, particularly for designs which are thermally cycled, to a large extent the tubes 12 are translated each with respect to the tube sheet 10 to result in wear 18 as shown and eventual cracking 20 of tubes 12 through the wall with the subsequent very undesirable mixing of the working fluids and/or tube rupture. Moreover, the heat exchanger design practice is such that the required tube thickness is greater than that required for heat exchange and pressure stress to: (1) prevent failure due to fatigue and wear on thin wall tubes, (2) minimize bending and vibration due to fluid oscillation, and (3) add overall sturdiness to the tube sheets. The overall total cost of the added tube material both in terms of the initial capital cost and as well the operating cost to the diminished heat exchange (caused by the thick tube wall thermal resistance) is significant when the total number of tube heat exchangers on line operation in the world is considered.

In addition, the large financial and legal liability factors associated with heat exchangers particularly in hazardous potential operations such as nuclear or high-pressure steam or chemical plants, the reduction of heat exchanger tube failures is very desirable. Moreover, the heat exchanger down time and repair aspects of the heat exchanger component often result in substantial product loss.

SUMMARY OF THE INVENTION

Accordingly, there is provided by the present invention a slide guide of thin sheet metal or other type similar material which is inserted into the heat exchanger tube support, sheet, or flow baffle, which is preferred in an axisymmetric shape, but not limited to this, through which the tube is extended. Moreover, this slide guide has an expansive capability such that it locks snugly into the aforesaid sheet and prevents rattling in a radial, axial or angular direction. The preferred slide guide length L is in the range of 104 diameters. Slots of $\frac{1}{4}$ to $\frac{3}{8}$ L on the guide extremities allow springing of these elements around the tube so as to adhere to the tube circumference and thereby prevent rattling of the tube within the slide guide.

The through tube is thus allowed to smoothly translate or radially expand independent of other adjacent tubes during thermal transients with a large bearing area and, by the metal damping and springing nature, prevents tube primary or sympathetic vibration during fluid heat exchange operation.

OBJECTS OF THE INVENTION

Therefore, it is an object of the invention to provide a means for cushioning and stabilizing heat exchanger tubes so as to prevent abrasion, wear and tube cracking.

Another object of the present invention is to provide a thin heat exchanger tube having a better thermodynamic efficiency than prior state-of-the-art tubes.

Still a further object of the present invention is to provide a light-weight heat exchanger.

Yet another object of the present invention is to provide a heat exchanger having long life and low maintenance costs.

Other objects, advantages and novel features of the present invention will become apparent from the following detailed description of the invention when considered in conjunction with the accompanying drawings wherein like numerals represent like elements.

DESCRIPTION OF THE PREFERRED EMBODIMENTS

Figure 2:
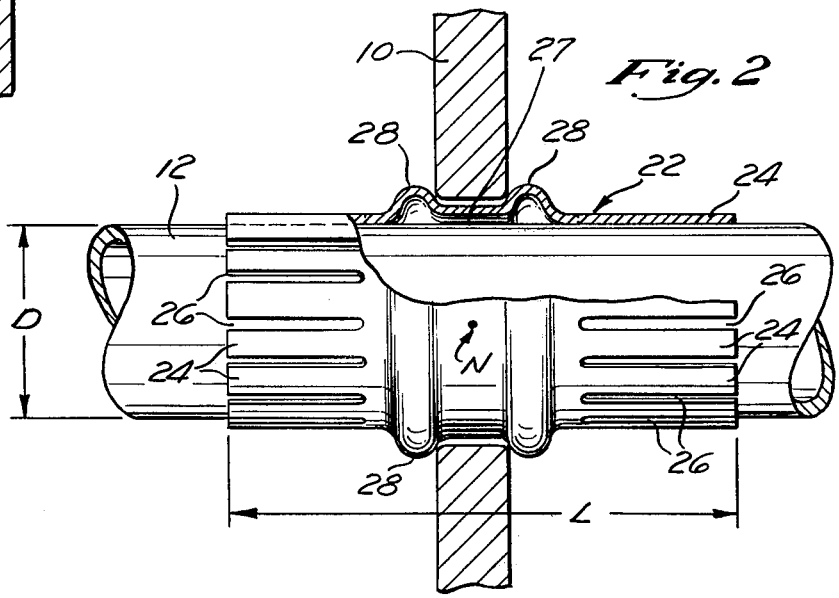
FIG. 2 is a schematic cross-sectional cutaway view of a tube-type heat exchanger element inserted through and cushioned from a tube support sheet by a flexible slide guide.

Referring now to FIG. 2, there is shown a cutaway cross-sectional view of the slide guide generally designated 22. Slide guide 22 is interposed between tube support sheet 10 and tube 12 and is designed to increase cost effectiveness and service life of a heat exchanger tube by distributing dynamic loads across a relatively large tube surface area and by permitting thin wall tubes to be incorporated into a tube-type heat exchanger.

Figure 1:
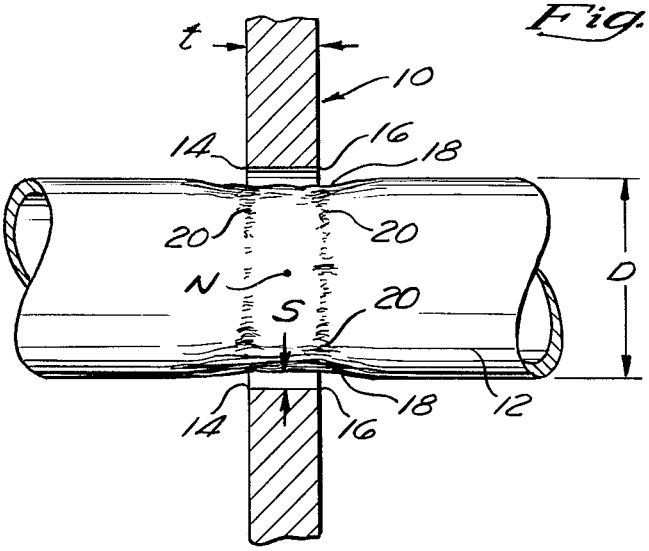
Fig. 1 (PRIOR ART)
FIG. 1 prior art is a schematic view of the heat exchanger tube inserted through a tube sheet.

Slide guide 22 is a flexible member constructed from sheet metal, plastic, or other material which is biased so as to conform to the tube ovality around the tube circumference. As shown, plurality of fingers 24 are formed by incorporating slots 26 into each end of the cylindrical slide guide 22. Fingers 24 conform to the tube surface with a relatively large bearing area thereby preventing high wear areas 18 such as shown in FIG. 1. The bearing area $A_B$ is proportional to the tube 12 diameter D and slide guide 22 length L. Thus, the bearing area can be calculated in accordance with the equation $A_B = \pi DL$. Although any increase in bearing area will enhance tube service life, the preferred L/D ratio is between about 2.0 and about 4.0, and the most preferred is about 3.0. Similarly, the slot portions can be of any length; however, the slots 26 preferably range in length from about $\frac{1}{4}$ L to about $\frac{3}{8}$ L, and the most preferred slot 26 length being about $\frac{1}{3}$ L. Structural damping is achieved by slide guide 22 through its ability to hug tube 12 with fingers 24. It should be noted that saddle 28 provides the means for anchoring slide guide 22 into tube support sheet port 30. Anchoring is accomplished by snapping slide guide 22 into place by a simple tap, typically with a hammer. The assembly of the tube support sheet 10, tube 12, and slide guide 22 can thus be achieved either by inserting tube 12 into guide 22 and snap pressing the assembly into tube support sheet 10 or inserting guide 22 into tube support sheet 10 and then placing tube 12 inside guide 22.

The flexibility of guide 22 is such that (1) it snaps through the tube support sheet 10 axially and then (2) radially expands to fit nearly the shape of the tube support sheet hole 30 in a snug manner. The resultant assembly thus has the capability to allow the tube to slide axially with a minimum restraint and as a result of gap 27 has the ability for limited radial tube expansion, contraction, and angular motion around the nodal point N. The metal vibration damping caused by the combined tube 12, slide guide 22 and tube support sheet/baffle 10 will prevent the axial, radial and angular displacement excursion which would otherwise develop wear and fatigue cracks on thin wall tubes.

Figure 3:
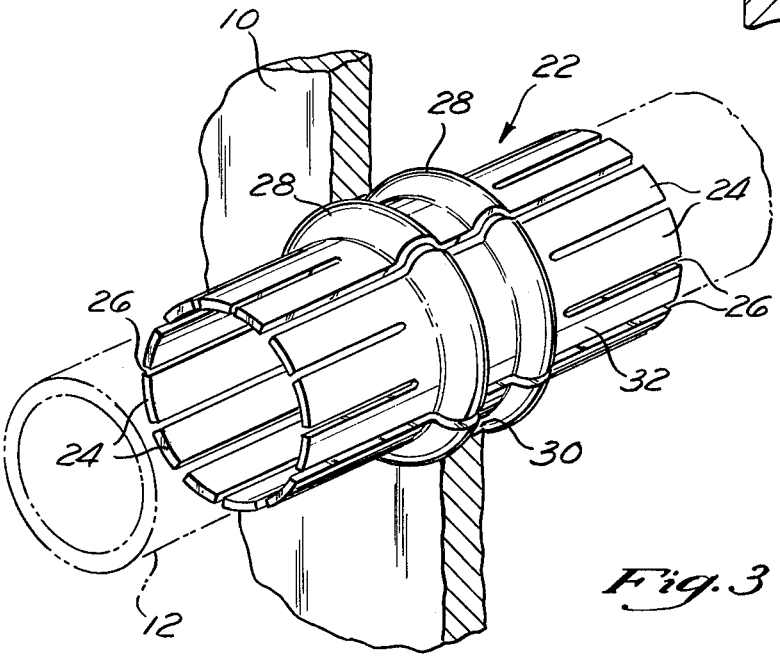
FIG. 3 is a perspective view of a slide guide comprising a plurality of guide elements.

It should be noted that although slide guide 22 is shown as a unibody element in FIG. 2, it can comprise a plurality of guide elements 32 each comprising an arcuate segment of the slide guide 22 which will be held in place within tube support sheet port 30 by tube 12, FIG. 3.

Obviously, many modifications and variations of the present invention are possible in light of the above teachings. It is, therefore, to be understood that, within the scope of the appended claims, the invention may be practiced otherwise than as specifically described.

What is claimed as new and is desired to be secured by Letters Patent of the United States is:

1. A tube-type heat exchanger, wherein the improvement comprises a slide guide interposed between the heat exchanger tube and the tube support sheet for preventing abrasion and high localized stress on heat exchanger tubes and wherein said slide guide comprises:

a plurality of fingers longitudinally extending from each end of said slide guide and biased so as to conform along their entire length to the ovality of said tube;

a saddle centrally located between said ends of said slide guide for positioning said slide guide within a tube support sheet; and a gap interposed between said saddle and said tube for permitting radial expansion and contraction of said tube and said tube support sheet.

2. The tube-type heat exchanger of claim 1 wherein said slide guide is of unibody construction.

3. The tube-type heat exchanger of claim 1 wherein said slide guide has a plurality of guide elements wherein each of said guide elements comprises an arcuate segment of said slide guide.

* * * * *